US005873674A

United States Patent [19]

Hohl

[11] Patent Number: 5,873,674

[45] Date of Patent: Feb. 23, 1999

[54] ROADWAY SAFETY WARNING SYSTEM AND METHOD OF MAKING SAME

[76] Inventor: Barney K. Hohl, 514 S. Clarion Dr., Pueblo West, Colo. 81007

[21] Appl. No.: 760,481

[22] Filed: Dec. 5, 1996

[51] Int. Cl.[6] ..... E01F 9/00

[52] U.S. Cl. ..... 404/9; 404/10; 404/13; 404/14; 404/16

[58] Field of Search ..... 404/1, 6, 7, 9, 404/10, 11, 12, 13, 14, 15, 16

[56] References Cited

U.S. PATENT DOCUMENTS

| | | | |
|---|---|---|---|
| 1,574,738 | 2/1926 | Cretney | 404/15 |
| 2,007,524 | 7/1935 | Emmons | 404/9 X |
| 2,532,988 | 12/1950 | Bigelow | 404/9 X |
| 4,790,684 | 12/1988 | Adams | 404/16 |
| 4,969,713 | 11/1990 | Wyckoff | 404/14 |
| 5,288,163 | 2/1994 | Munson | 404/9 |

*Primary Examiner*—Tamara L. Graysay
*Assistant Examiner*—Sunil Singh
*Attorney, Agent, or Firm*—Phillip A. Rein

[57] ABSTRACT

A roadway safety warning system and method of making same utilizing various ones of marking assemblies applied to a roadway surface to provide a warning system. The marking assemblies means includes 1) chevron marking assembly; 2) diagonal marking assembly; 3) perpendicular marking assembly; and 4) chevron and perpendicular marking assembly. The various marking means can have various embodiments thereof with 1) the chevron marking assembly being of a V-shape; 2) the diagonal marking assembly extended at an angle to a direction of travel; 3) the perpendicular marking assembly extended perpendicular to the direction of travel; and 4) the chevron and perpendicular marking assembly being a portion of both of a combination of the chevron marking assembly and the perpendicular marking assembly. The marking assemblies can be provided with various embodiments of reflector/refractor signal assembly provided with general reflector members which would be raised above the support roadway surface and could be flexible so as to be folded downwardly if a vehicle runs thereover. The reflector/refractor signal assembly has arcuate, inclined, and raised strip assemblies which provide an elevated surface a certain distance such as ½" to ¾" above the roadway surface to aid in observation thereof from a line of sight from vehicle drivers.

24 Claims, 4 Drawing Sheets

Fig. 6
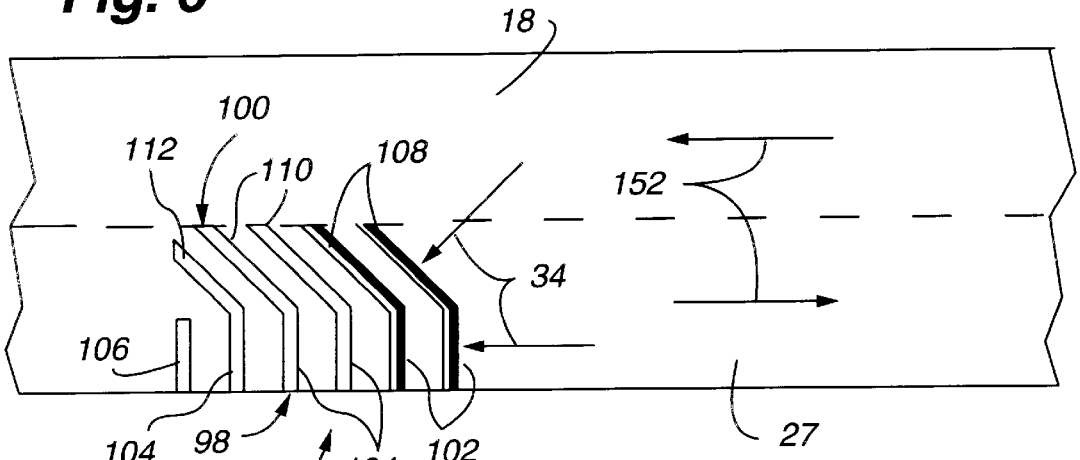
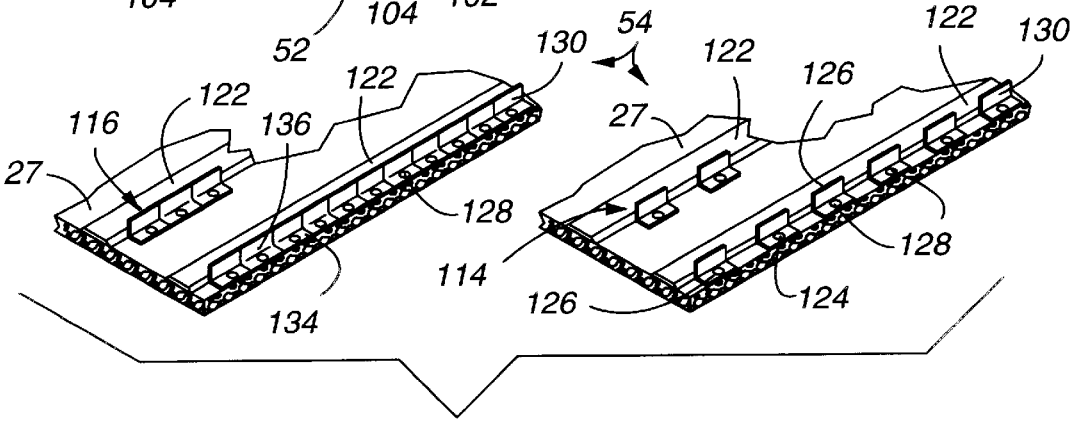
Fig. 7
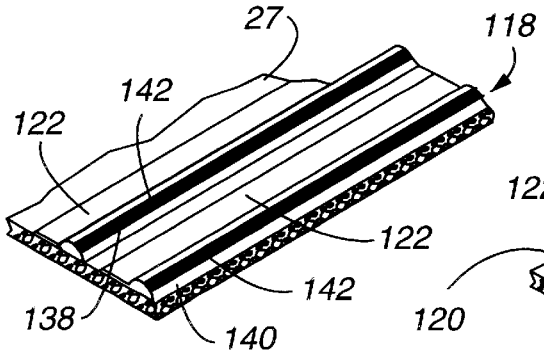
Fig. 8
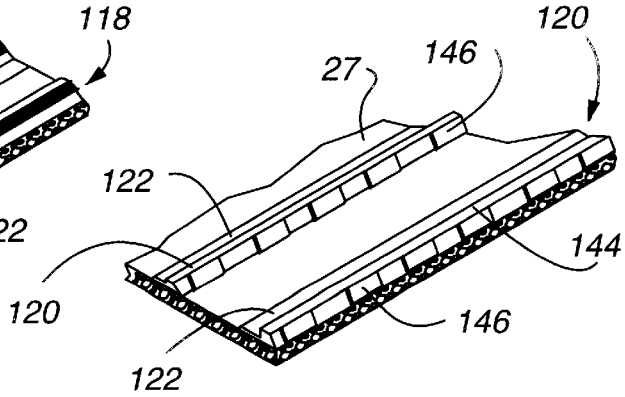
Fig. 9

ROADWAY SAFETY WARNING SYSTEM AND METHOD OF MAKING SAME

The Munson patent discloses an airport pavement marking system for surface movement guidance on an airport runway to direct airport traffic. This patent teaches indicia applied to the roadway to provide traffic and guidance information as a patentable combination.

PREFERRED EMBODIMENT OF THE INVENTION

In one preferred embodiment of this invention, a roadway safety warning system and method of making same is provided utilizing a roadway complex system having vehicles traveling thereupon with the invention being operable to provide a warning system to alert vehicle drivers of an approaching intersection which may provide a dangerous driving and vehicle turning situation.

The roadway complex includes 1) two-lane side roadways; 2) two-lane highway roadways; and 3) four-lane highway roadways which have the two-lane side roadways and two-lane highway roadways intersecting each other and the four-lane highway roadways.

The roadway complex is further provided with marking indicia on a roadway surface including 1) numerous turning lanes; 2) no-passing double solid lines; 3) dash pass with caution line to indicate pass and no-pass caution areas; and 4) corner turn guide lines to guide a vehicle into a proper turning path at various intersections.

Each vehicle is provided with a vehicle driver shown in the drawings as having a line of sight in various forward and side directions so as to observe the various highway surface marking used in the roadway safety warning system of this invention as will be noted.

Further, the roadway complex is provided with 1) numerous stop signs; 2) yield signs; and 3) caution/instruction signs to be placed at various positions on the schematic diagrams of FIGS. 1 and 2 as noted thereon.

The roadway safety warning system and method of making same includes 1) chevron markings means or assembly; 2) diagonal marking means or assembly; 3) perpendicular marking means or assembly; 4) chevron and perpendicular marking means or assembly; and 5) reflector/refractor signal means or assembly, all to be applied to a roadway surface by anchor members, paint, or plastic sheet material with use of an adhesive.

The chevron marking means includes numerous embodiments having one or more stripes meeting at an angle and being of generally V-shape. The chevron marking means includes 1) a chevron marking assembly; 2) a chevron block style marking assembly; 3) a chevron integral block style marking assembly; and 4) a single chevron marking assembly.

As noted in FIG. 3, the chevron marking assembly can be of a size to cover a single lane in a two-lane highway roadway or a larger dual lane structure to cover both lanes going in one direction such as found on a four-lane highway roadway.

Each chevron marking assembly includes 1) one or two lead chevron stripes; 2) a plurality of intermediate chevron stripes; and 3) a rear chevron stripe. All of the stripes are in an adjacent, nestled relationship with each other.

The lead chevron stripes are constructed of a reflector type material on its leading edges thereof or throughout so as to be readily observed by a vehicle driver as will be noted.

Each of the stripes may be painted on the highway roadway surface or can be of a durable plastic sheet material which is anchored as by an adhesive material to the highway roadway surface in a desired position.

The chevron block style marking assembly, as shown in FIG. 3, is provided within a generally rectangular outline including 1) lead chevron stripes; 2) partial lead chevron stripes; 3) intermediate chevron stripes; and 4) a trailing chevron stripe.

The lead chevron stripes and partial lead chevron stripes are preferably constructed with a main body section having an integral reflector section.

As noted in FIG. 3, the intermediate chevron stripes are as previously noted. The trailing chevron stripe is a partial pointed form to achieve the overall block style therewith.

The chevron integral block style marking assembly is embodied within a rectangular outline having the lead chevron stripe, the partial lead chevron stripes, the intermediate chevron stripes, and the trailing chevron stripe as previously described for the chevron block style marking assembly.

The chevron integral block style marking assembly is provided with a central anchor section which is integral with the lead chevron stripe, the intermediate chevron stripes, and the trailing chevron stripe to provide continuous support thereto.

The single chevron marking assembly is provided with a lead chevron stripe interconnected at outermost ends thereof to a rear connector stripe. A plurality of the single chevron marking assemblies may be utilized on the roadway surface at predetermined integrals (see FIGS. 1 and 2) to give the proper warning notice to vehicle drivers stopped at a stop sign at an intersection as will be explained.

As noted in FIG. 4, the diagonal marking means are provided with two embodiments being in opposite degrees of inclination relative to a direction of travel on the roadway surface, each having a diagonal marking assembly. Each diagonal marking assembly includes 1) lead diagonal stripes; 2) intermediate diagonal stripes; and a rear diagonal stripe.

The two lead diagonal stripes are preferably constructed of a highly durable wear-resistant plastic sheet material having a main body section integral with a forward reflector section so as to be observed in a line of sight by the vehicle driver as will be noted.

As shown in FIG. 6, the chevron and perpendicular marking means is of a block style within a rectangular outline. The chevron and perpendicular marking means includes a perpendicular marking section operably connected to a chevron marking section.

The perpendicular marking section includes 1) a pair of lead stripe members; 2) intermediate stripe members; and 3) a rear stripe member. The lead stripe members are of a plastic sheet material preferably constructed with the main body section having the forward reflector section.

The chevron marking section includes 1) a pair of lead chevron members integral with the adjacent respective lead stripe members; 2) intermediate chevron members integral with respective ones of the intermediate stripe members; and 3) a rear chevron member integral with the rearmost intermediate stripe member.

The chevron and perpendicular marking means is to provide warning forward reflector sections or surfaces, both extended diagonally to the direction of roadway travel and perpendicular thereto and, therefore, is constructed from a combination of one-half of a chevron marking means and one-half of a perpendicular marking means.

The reflector/refractor signal means is provided with numerous embodiments which can be utilized as the lead stripes in the previously described marking means as will be explained.

The reflector/refractor signal means includes 1) an intermittent stripe assembly; 2) a continuous stripe assembly; 3) an arcuate raised stripe assembly; and 4) an inclined raised stripe assembly.

The intermittent stripe assembly includes a striping base member having a reflector stripe member connected thereto. The striping base member is a support element being connected along the forward leading edge to the reflector stripe member. The reflector stripe member has a main support body of L-shape and secured to the striping base member by an anchor member. Each reflector stripe member is an independent element having an upright reflector section supporting a reflector material thereon.

The continuous stripe assembly is similar to the intermittent stripe assembly having the striping base member with a continuous reflector stripe member connected to a leading edge thereof and having a continuous reflector surface thereon.

The reflector stripe member is connected to the striping base member by the anchor members.

The arcuate raised stripe assembly includes the striping base member having a forward edge connected to an arcuate reflector member. The arcuate reflector member has an upper curved surface with a support member having a stripe reflector member secured and extended longitudinally thereon.

The inclined raised stripe member is substantially identical to the arcuate raised stripe member having a striping base member with an inclined reflector member on a front surface thereof The inclined reflector member is provided with a stripe reflector member thereon.

In the method of making a roadway safety warning system of this invention, the following steps are noted:

1) surveying respective two-lane highway roadways intersecting another two-lane highway roadway and/or a four-lane highway to determine the placement of various turning lanes, stop signs, yield signs, and caution/instruction sign in the proper positions thereabout which is usually done under government specifications and regulations;
2) analyzing and measuring various distances from stop sign intersections in order to determine the proper placing of marking means on the roadway surfaces;
3) analyzing the placement of vehicles at various stop sign points and observing the line of sight available to vehicle drivers to the oncoming approaching traffic from other vehicles;
4) measuring off predetermined distances from the various intersections to determine the proper placement of the marking means on the roadway surfaces;
5) measuring the proper spacing and positioning of the marking means to provide sufficient warning to the vehicle drivers to their line of sight from a stationary position at a stop sign;
6) determining the proper one of the marking means to be utilized, whether a chevron, diagonal, perpendicular, or chevron and perpendicular marking means;
7) determining which one of the marking means would be appropriate for a given location on approaching an intersection to be observed through the line of sight of a vehicle driver in their respective vehicles; and
8) deciding which one of the reflector/refractor signal means would be utilized with the subject marking means to provide the most cost efficient and effective roadway safety warning system for each particular two-lane or four-lane highway roadway intersection.

OBJECTS OF THE INVENTION

One object of this invention is to provide a roadway safety warning system and method of making same on roadway surfaces relative to turning intersections utilizing stop and yield signs wherein the warning system would be cost efficient and effective in providing visual warnings to vehicle drivers 1) stationary at a stop sign or 2) approaching a given intersection as to a potential dangerous driving condition where vehicles may be crossing another vehicle's intended path of travel.

Another object of this invention is to provide a roadway safety warning system and method of making same to provide marking means on roadway surfaces being of various illuminated, reflector, or refractor warning stripes visible to vehicle drivers stationary at a stop sign or traveling on the roadway of a possibly dangerous intersection whereupon caution must be taken to prevent possible accidents and resultant injury therefrom.

One other object of this invention is to provide a roadway safety warning system and method of making same utilizing a plurality of different marking means being chevron, diagonal, perpendicular, and a combination chevron and perpendicular which are chosen to provide the utmost visual warning system to vehicle drivers in vehicles in a potentially dangerous turning intersection area.

A further object of this invention is to provide a roadway safety warning system and method of making same utilizing reflector/refractor signal means of various embodiments being intermittent, continuous, arcuate, and inclined raised stripe assemblies to provide a visual reflective means on a roadway surface to vehicle drivers placed near turning intersections not having the benefit of an illuminated signal light system.

One further object of this invention is to provide a roadway safety warning system and method of making same near intersecting two-lane highway roadways or an intersection of a four-lane highway roadway with a two-lane highway roadway to provide a method of providing visual reflector stripes in a most efficient and cost effective manner.

Still, one other object of this invention is to provide a roadway safety warning system and method of making same which can be readily applied through a painting process or plastic striping material to a concrete or asphalt roadway surface which is economical to manufacture; easy to apply to a given roadway surface; provided with striping base members having a portion thereof provided with a reflective section; utilizing a reflector signal or marking means which can be elevated about the support surface; durable in construction; easy to replace; and substantially maintenance free.

Various other objects, advantages, and features of the invention will become apparent to those skilled in the art from the following discussion, taken in conjunction with the accompanying drawings, in which:

FIGURES OF THE INVENTION

FIG. 6 is a fragmentary top plan view of a two-lane roadway having a chevron and perpendicular marking means of this invention;

FIG. 7 is a fragmentary perspective view of an intermittent and a continuous stripe assembly of a reflector/refractor signal means of this invention;

FIG. 8 is a fragmentary perspective view illustrating an arcuate raised stripe assembly of the reflector/refractor signal means of this invention; and FIG. 9 is a fragmentary perspective view of an inclined raised stripe assembly of the reflector/refractor signal means of this invention.

Figure 1:
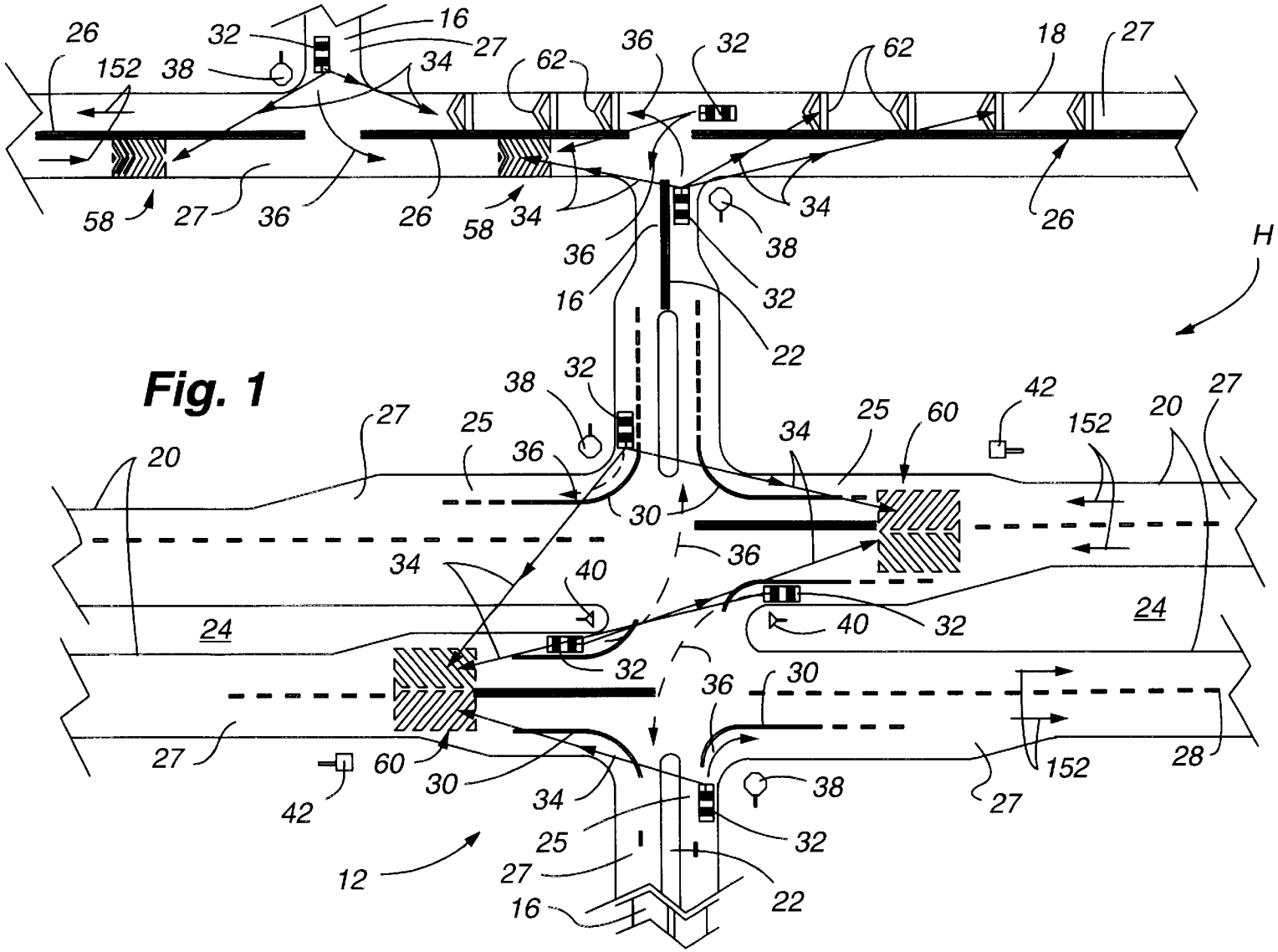
FIG. 1 is a schematic diagram illustrating an intersection of 1) a major four-lane highway roadway with a two-lane highway roadway; and 2) a two-lane side roadway with a two-lane highway roadway.

The following is a discussion and description of preferred specific embodiments of the roadway safety warning system and method of making same of this invention, such being made with reference to the drawings, whereupon the same reference numerals are used to indicate the same or similar parts and/or structure. It is to be understood that such discussion and description is not to unduly limit the scope of the invention.

BACKGROUND OF THE INVENTION

A main objection of this invention is to limit the loss of human life on our roadways by use of reflective paint or plastic sheet strips applied diagonally at a 45 degree to a 90 degree perpendicular angle to a direction of traffic travel that vehicles in an opposite lane could detect a relative safe zone for making turns and through crossings and intersections not controlled by an electrical traffic signal system. Further, reflective road markers positioned at the center line, left, and right road borders, plus a reflective/refractive strip on a leading edge would be of a different color to alert vehicle drivers that traffic is approaching a critical zone and attempt to make turns or crossings with caution. The reflective/refractive strips would be visible to oncoming traffic in inclement weather such as rain, light snow, light fog, and during darkness.

There are several possibilities in regard to type and placement of the reflective road markers or marking means as follows:

I. The marking means would have to be placed three and possibly four times the distance for which the oncoming vehicle (vehicle speed per second) is traveling before it reaches the approaching intersection. For example, if the oncoming vehicle is traveling at 55 MPH, the marking means would have to be 242 feet (travel distance in three seconds at 55 MPH) from the approaching intersection for safety consciousness and four or five times the distance would be better.

II. There could be several marking means with reflectors/refractors placed at second intervals with relation to the speed of the oncoming vehicle. The last reflector/refractor would be a different color to warn vehicle drivers not to attempt a turn or crossing at three, four, or five seconds before reaching the intersection.

III. A combination of lines, reflectors/refractors, and marking means can be applied to the roadway surfaces and spaced in regard to speed and time intervals.

The roadway safety warning system and method of making same would reduce the number of accidents and fatalities at uncontrolled intersections, hence benefiting the public interest. The invention would be economically prudent for communities with limited resources, i.e., to avoid the cost of installing traffic signals where the cost is prohibitive. Besides increasing public safety awareness, insurance carriers would benefit by a decrease in accidents and their associated costs.

The following "TABLE A" sets forth a distance a vehicle will travel in feet per second (fps) at a given speed in miles per hour (MPH) beginning at 10 MPH through 120 MPH at 5 MPH increments. The feet distances are rounded to the nearest foot and indicate critical distances for application of the roadway marking means on the roadway surface and travel per second of a vehicle being from 1 to 5 seconds away from a critical intersection. The tables is as follows:

TABLE A

| | MPH x's 1 | MPH x's 2 | MPHx's 3 | MPH x's 4 | MPH x's 5 |
|---|---|---|---|---|---|
| 10 mph | 15 fps | 29 feet | 44 feet | 58.68 feet | 73 feet |
| 15 mph | 22 | 44' | 66' | 88' | 110' |
| 20 mph | 29 | 59' | 88' | 117' | 147' |
| 25 mph | 37 | 73' | 110' | 147' | 483' |
| 30 mph | 44 | 88' | 132' | 176' | 220' |
| 35 mph | 51 | 103' | 154' | 205' | 257' |
| 40 mph | 59 | 117' | 176' | 235' | 293' |
| 45 mph | 66 | 132' | 198' | 264' | 330' |
| 50 mph | 73 | 147' | 220' | 293' | 367' |
| 55 mph | 81 | 161' | 242' | 323' | 403' |
| 60 mph | 88 | 176' | 264' | 352' | 440' |
| 65 mph | 95 | 191' | 286' | 381' | 477' |
| 70 mph | 103 | 205' | 308' | 411' | 513' |
| 75 mph | 110 | 220' | 330' | 440' | 550' |
| 80 mph | 117 | 235' | 352' | 469' | 587' |
| 85 mph | 125 | 249' | 374' | 499' | 623' |
| 90 mph | 132 | 264' | 396' | 528' | 660' |
| 95 mph | 139 | 279' | 418' | 557' | 697' |

TABLE A-continued

| | MPH x's 1 | MPH x's 2 | MPHx's 3 | MPH x's 4 | MPH x's 5 |
|---|---|---|---|---|---|
| 100 mph | 147 | 293' | 440' | 587' | 733' |
| 105 mph | 154 | 308' | 462' | 616' | 770' |
| 110 mph | 161 | 323' | 484' | 645' | 807' |
| 115 mph | 169 | 337' | 506' | 675' | 843' |
| 120 mph | 176 | 352' | 528' | 704' | 880' |

The opposing lanes of traffic would detect a relative safe zone for making turns and crossings at controlled and uncontrolled intersections by use of the marking and signal means. This would be especially effective on high speed thoroughfares in rural areas. Due to the fact some individuals run stop signs and stop lights, the roadway marking means would offer a buffer zone for other vehicle drivers.

The marking means would have to be placed three to six times the distance relative to the speed of the oncoming vehicle in order for vehicle drivers to execute safe crossings. Refer to TABLE A. There should be a safety factor built in, but not too much as the public would disregard the marking means. Traffic informaton would need to be installed stating "CAUTION—REGULATED SPEED ZONE" or "CONTROLLED SPEED ZONE" or something of this nature to alert vehicle drivers.

The roadway safety warning system and method of marking same is twofold. First this invention would alert vehicle drivers that a possible hazard exits with merging or crossing traffic and not to exceed the posted speed limit. Second, the invention would give vehicle drivers stopped at a stop sign at intersections or turn lanes, a buffer zone for making turns or proceeding through crossings. The result would be the saving of lives, reduction in accidents and injury, and the costs associated with accidents.

As the oncoming vehicle traffic approaches the roadway marking means, the marking means would alert other vehicle drivers not to attempt to make a turn or crossing, that not enough time exists at that posted speed limit to safely execute a turn or crossing. The reflective marking means would alert vehicle drivers of opposing and intersecting traffic that a relative safe zone exists beyond the marking means and a critical zone exists this side of the marking means. The reflective/refractive signal or marking means would enhance visibility for night driving and in fog, rain, and snow conditions.

At night, as oncoming traffic vehicles approach the roadway marking means, some of the vehicles headlight beam would reflect back off the marking means alerting the vehicle driver that a possible hazard exists with merging and/or crossing traffic associated with an intersection and not to exceed the posted speed limit. The opposing and intersecting vehicle drivers would be able to see the refracted light off the marking means. As the oncoming traffic vehicles pass this intersection point, the marking means would no longer be visible alerting the vehicle drivers not to attempt to make a turn at the intersection.

DESCRIPTION OF THE INVENTION

On referring to the drawings in detail, and in particular to FIG. 1, a roadway safety warning system and method of making same of this invention, indicated generally at 12, has a roadway complex 14 shown in a schematic diagram to be utilized by a plurality of vehicles 32 having vehicle drivers therein. The invention is utilized to provide a general warning system of a possible dangerous traffic situation to be marked on asphalt or concrete pavement surfaces to provide warning to vehicle drivers as to dangerous turning conditions at an intersection.

The roadway complex 14 can be of various configurations and embodiments utilizing 1) a two-lane side roadway 16 normally referred to as a minor road intersection; 2) a two-lane highway roadway 18 which would be a paved roadway intersecting a major roadway; and 3) a four-lane highway roadway 20 which is normally of a high speed divided interstate highway into which intersecting side and highway roadways 16, 18 are connected.

The two-lane highway roadway 18 is usually provided with a separation median or highway markings 22 for separation of vehicle travel at a stop intersection.

The four-lane highway roadway 20 can be separated by painted lines but, on an interstate highway system, is provided with lane separation medians 24 to provide a separation between two inside lanes of high speed traffic proceeding in opposite directions to provide a safety feature therebetween.

The respective highway roadways 16, 18, 20 are provided with 1) turning lanes 25; 2) no-passing double solid lines 26; 3) a roadway surface 27 to which the roadway marking means are applied as by plastic strips or painted strips; 4) dash pass with caution line 28; and 5) corner turn guide lines 30.

The schematic diagrams of FIGS. 1 and 2 refer to a vehicle 32 having a vehicle driver therein having a line of sight 34 to observe various marking means of this invention as will be explained. The line of sight 34 of the vehicle driver within a respective vehicle 32 is illustrated in a respective straight dashed-line having two arrowheads thereon to show expected observance of the marking means by the vehicle driver.

Each of the vehicles 32 are shown with an arcuate dotted line being the vehicle intended path of travel 36 which is normally a proposed turning lane movement.

A plurality of stop signs 38, yield signs 40, and caution/instruction signs 42 are provided to control movement of the various vehicles 32 after they have normally come to a stop at the respective stop signs 38 in an attempt to make a left or right hand turn and needs to be warned about approaching traffic conditions.

The roadway safety warning system and method of making same 12 includes 1) chevron marking means 46; 2) diagonal marking means 48; 3) perpendicular marking means 50; 4) chevron and perpendicular marking means 52; and 5) reflector/refractor signal means 54.

The various marking means 46, 48, 50, 52 are preferably constructed of a strip material, being a durable high-strength plastic sheet material, which can be readily attached to the roadway surface 27 as by well known adhesive materials.

In the alternative, the marking means 46, 48, 50, 52 can be attached to the roadway surface 27 through use of a painting medium using white, yellow, or red of which the yellow and red colors can be of a reflective type paint material.

The chevron marking means 46 includes chevron stripes having inclined sections which are interconnected centrally and forming an angle therebetween. The chevron marking means 46 includes various embodiments being 1) a chevron marking assembly 56; 2) a chevron block style marking assembly 58; 3) a chevron integral block style marking assembly 60; and 4) a single chevron marking assembly 62.

The chevron marking assembly 56 can be of one size to cover a single lane of traffic or a double size to substantially cover a dual lane of traffic such as found in the four-lane highway roadway 20. These two embodiments are substantially identical differing in overall size.

Each chevron marking assembly 56, 58, 60 includes 1) lead chevron stripes 64; 2) intermediate chevron stripes 66; and 3) a rear chevron stripe 68.

All of the chevron stripes 64, 66, 68 are provided with a main body section 70 of a paint material or plastic striping sheet material. The lead chevron stripes 64 are also provided with a forward reflector section 72 which can be constructed of an illuminated stripe material or painted surface having a reflective material thereon or utilizing one of the reflector/refractor signal means 54 as will be explained.

Figure 2:
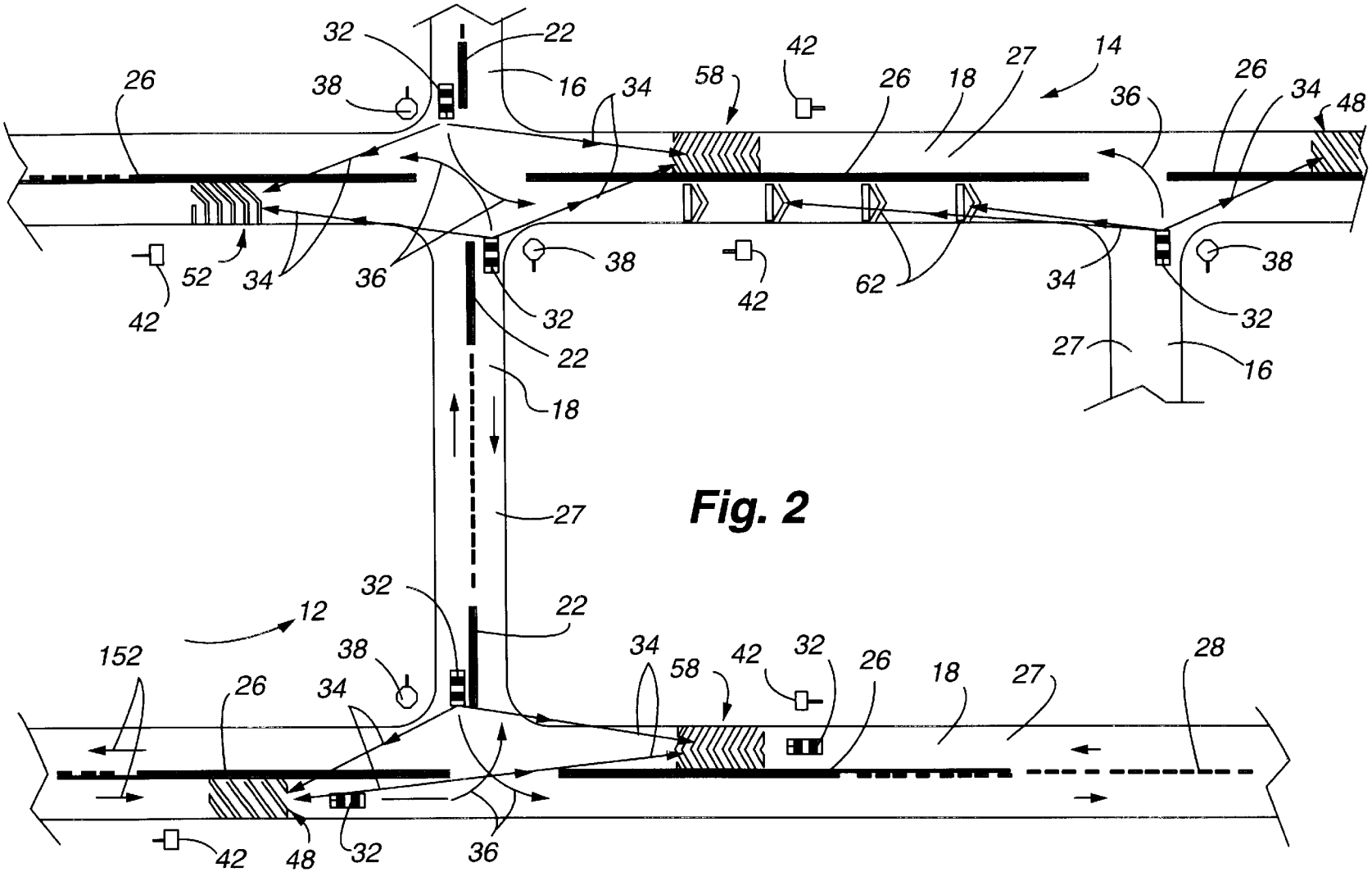
FIG. 2 is a schematic diagram illustrating the roadway safety warning system and method of making same as utilized with an intersection of spaced parallel two-lane highway roadways with two-lane side roadways.

As noted in FIG. 2, a chevron block style marking assembly 58 is provided with two embodiments utilizing 1) the lead chevron stripes 64; 2) partial lead chevron stripes 74; 3) the intermediate chevron stripes 66; and 4) a trailing chevron stripe 76.

The lead chevron stripes 64 and the partial lead chevron stripes 74 are provided with an illuminated front surface.

Figure 3:
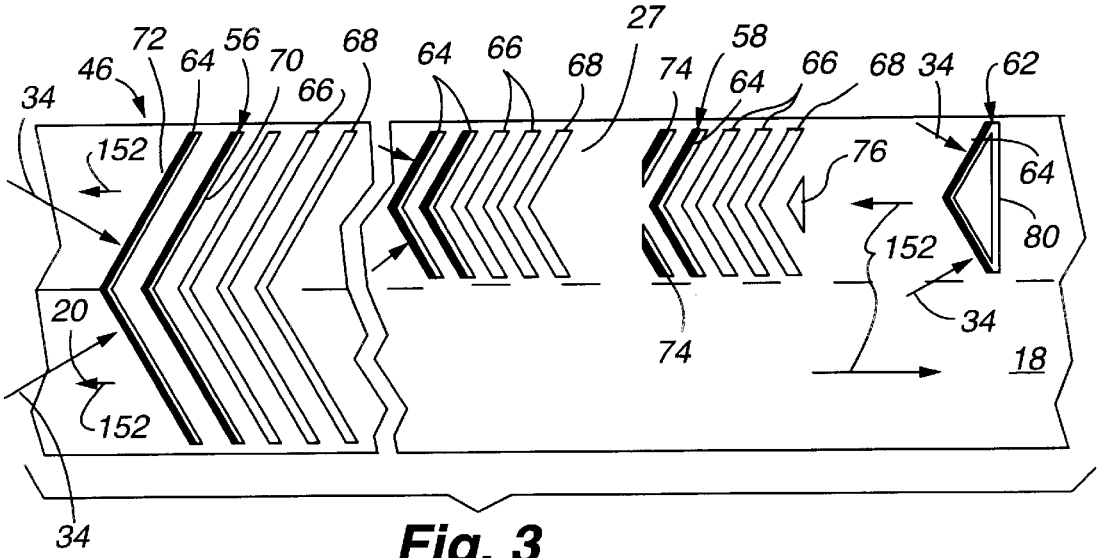
FIG. 3 is a fragmentary top plan view of a two-lane roadway having a chevron marking means of this invention.
Figure 3A:
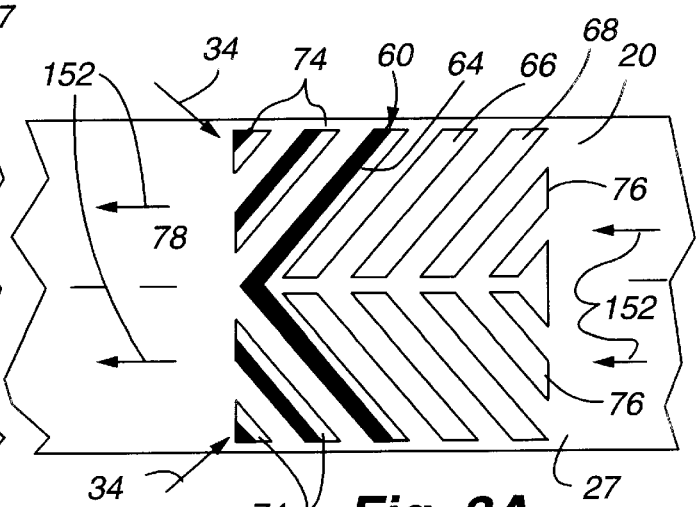
FIG. 3A is a plan view similar to FIG. 3 having another embodiment of the chevron marking means.

As noted in FIG. 3A, the chevron integral block style marking assembly 60 includes 1) the lead chevron stripes 64; 2) the partial lead chevron stripes 74; 3) the intermediate chevron stripes 66; and 4) the trailing chevron stripes 76. An inner surface of all of the lead chevron stripes 64, the intermediate chevron stripes 66, and the trailing chevron stripes 76 are interconnected to a central anchor section 78.

As noted in FIG. 3, the single chevron marking assembly 62 includes a lead chevron stripe 64 and a rear connector stripe 80.

With this embodiment of FIG. 3A being the chevron integral block style marking assembly 60, it is preferably constructed of a plastic sheet material of integral design and, thus, easier to accurately apply to the roadway surface 27 not having a plurality of individual pieces as set forth in the embodiment of FIG. 3 being the chevron block style marking assembly 58.

Figure 4:
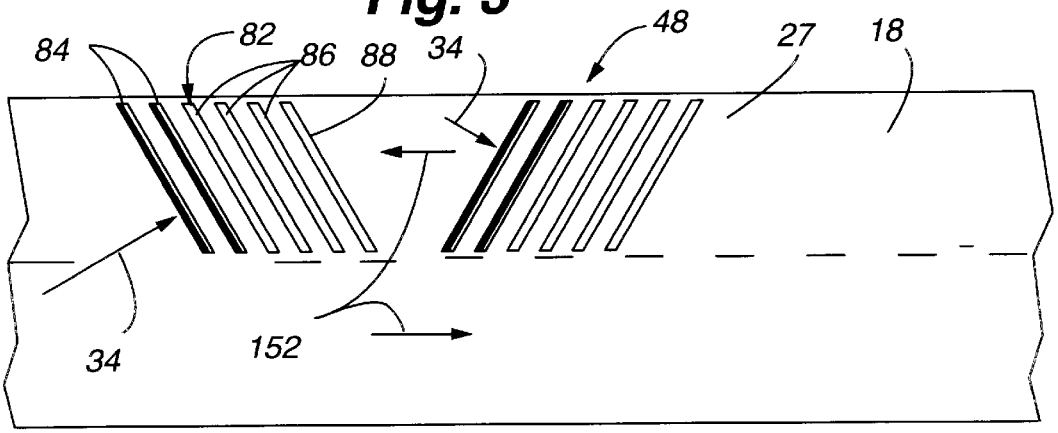
FIG. 4 is a fragmentary top plan view of a two-lane roadway having a diagonal marking means thereon.

As noted in FIG. 4, the diagonal marking means 48 has two embodiments thereof being inclined in opposite directions in regard to a vehicle 32 direction of travel 152. The diagonal marking means 48 can be constructed in a block style as shown in FIG. 2.

Other than inclination relative to the direction of travel 152, the diagonal marking means 48 includes a diagonal marking assembly 82, each having lead diagonal stripes 84; 2) intermediate diagonal stripes 86; and 3) a rear diagonal stripe 88.

All of these stripes 84, 86, 88 are constructed of either a paint material or plastic strip sheet material as previous described with the lead diagonal strips 84, each provided with a forward reflective surface or associated with the reflector/refractor signal means 54 as will be explained.

Figure 5:
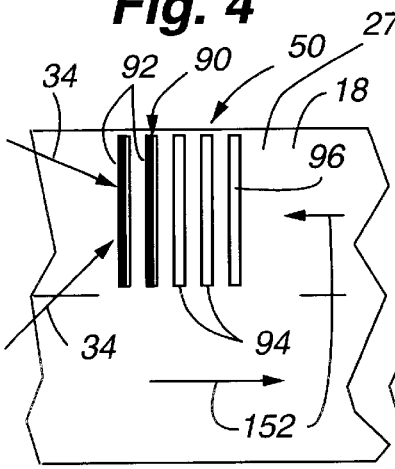
FIG. 5 is a fragmentary top plan view having a perpendicular marking means thereon.

As shown in FIG. 5, the perpendicular marking means 50 consists of adjacent, parallel marking strips extended perpendicular to the direction of travel 152. More specifically, the perpendicular marking means 50 includes a perpendicular marking assembly 90 having 1) lead stripes 92; 2) intermediate stripes 94; and 3) a rear stripe 96. The stripes 92, 94, 96 can be painted on the roadway surface 27 or be a plastic strip sheet material. The lead stripes 92 include a forward section provided with a reflective material or used with the reflector/refractor signal means 54.

The chevron and perpendicular marking means 52 is a combination of one-half of the perpendicular marking means 50 (FIG. 5) and the one-half of chevron marking means 48 (FIG. 3). The chevron and perpendicular marking means 52 is preferably constructed in a block style configuration having 1) a perpendicular marking section 98; and 2) a chevron marking section 100 integral with the perpendicular marking section 98.

As noted in FIG. 2, the chevron and perpendicular marking means 52 is utilized so as to be readily visible to the line of sight 34 to respective vehicle drivers in the vehicles 32 stopped at different stop signs 38.

The perpendicular marking section 98 includes 1) lead stripe members 102; 2) intermediate stripe members 104; and 3) a rear stripe member 106, all extended perpendicular to the direction of travel 152.

The chevron marking section 100 includes 1) lead chevron members 108; 2) intermediate chevron members 110; and 3) a rear chevron member 112, all integrally connected to adjacent portions of the perpendicular marking section 98.

As shown collectively in FIGS. 7, 8, and 9, the reflector/refractor signal means 54 utilizes reflectors being a surface that reflects light, such as a polished surface, and a refractor surface which subjects rays of light to refraction therefrom. Whether utilizing reflector or refractor type surfaces, the object is to provide a visual signal or reflection of light to be received in the line of sight 34 of the vehicle driver in a respective vehicle 32.

The reflector/refractor signal means 54 includes 1) an intermittent strip assembly 114 as shown in FIG. 7; 2) a continuous strip assembly 116 as shown in FIG. 7; 3) an arcuate raised strip assembly 118 as shown in FIG. 8; and 4) an inclined raised strip assembly 120 as shown in FIG. 9.

The various strip assemblies 114, 116, 118, 120 can be utilized with the lead stripes as previously described in the various marking means 46, 48, 50, 52 to provide a warning reflective surface.

The intermittent strip assembly 114 includes a striping base member 122 having a reflector strip member 124 secured to a leading edge of the striping base member 122.

The reflector strip member 124 is provided with a main support body 126 of generally L-shape which is secured on one leg thereof as by an anchor member 128 to the roadway surface 27 of the supporting concrete or asphalt base material. The main support body 126 has an upright leg provided with a reflector section 130 thereon.

The reflector strip member 124 is provided with a plurality of spaced ones of the main support bodies 126 secured to the striping base member 122.

The continuous strip assembly 116 is substantially identical to the intermittent strip assembly 114 except having the elongated striping base member 122 having a continuous reflector strip member 130 connected thereto. The continuous reflector strip member 130 is provided with a main support member 134 of generally L-shape having a reflector strip member 136 mounted thereon and secured by a plurality of the anchor members 128 to the adjacent supporting asphalt or concrete roadway.

As noted in FIG. 8, the arcuate raised strip assembly 118 includes the elongated striping base member 122 having an arcuate reflector member 138 secured thereto. The arcuate reflector member 138 includes a curved support member 140 having a strip reflector member 142 secured thereto which is similar to the continuous reflector strip 136.

As noted in FIG. 9, the inclined raised strip assembly 120 is substantially similar to the arcuate raised strip assembly 118 including the striping base member 122 having an inclined reflector member 144 secured along a leading or front edge thereof The inclined reflector member 144 is provided with a strip reflector member 146 thereon.

Both the arcuate raised strip assembly 118 and the inclined raised strip assembly 120 are constructed of a minimum height such as ½" to ¾" and provided with the front surface with the respective strip reflector members 142, 146 mounted thereon for ease of observance by a vehicle driver in its line of sight 34 in a vehicle 32 as will be explained.

In the method of making or constructing the roadway safety warning system 12 of this invention, the engineer designer would first take into consideration the speed limits involved and the traffic flow in areas adjacent each intersection. For example, the single chevron marking assemblies 62 may be selectively placed at one second intervals relative to the speed of travel 152 in, for example, a 55 MPH highway speed limit. On referring to "TABLE A", each of these single chevron marking assemblies 62 are placed at one second intervals at 55 MPH or approximately 81 feet from each other and the dangerous intersection. Therefore, the visual single chevron marking assembly 62 will be placed at a given distance from the intersection and repeated every 81 feet as noted in FIGS. 1 and 2 which can give warning every second of travel and for a selected period of 3 to 6 seconds from an intersection to give the vehicle driver proper time for response.

Also, the placing of any of the marking means 46, 48, 50, 52 would be at a proper distance from a dangerous intersection and being readily visible within the line of sight 34 of the vehicle driver in the vehicle 32 normally stopped at a stop sign 38. This distance will vary depending on the prevailing roadway speed limits but must be placed near an intersection to provide the necessary warning signal to both the approaching vehicle drivers and the vehicle driver stopped at the stop sign 38.

Also, the type of marking means to be applied to the respective roadway surface 27 and whether being chevron, diagonal, perpendicular, or the chevron and perpendicular marking means 46, 48, 50, 52 depends on the various intersections of the highway roadways 16, 18, and 20 as noted in FIGS. 1 and 2.

USE AND OPERATION OF THE INVENTION

In the use and operation of the roadway safety warning system and method of making same 12 of this invention, the various types of roadways 16, 18, 20 need to be considered to determine the proper positioning of the turning lanes 25 and marking means to be used therewith.

For example in FIG. 1, a major intersection of a roadway complex 14 includes three (3) of two-lane side roadways 16 with a major four-lane highway roadway 20 and a two-lane highway roadway 18 is illustrated having four vehicles 32 in the stopped position adjacent a respective stop sign 38 in the two-lane roadways 16 and another two vehicles 32 positioned within turning lanes in the four-lane highway roadway 20. In this case, two of the chevron integral block style marking assemblies 60 are utilized which are important in the line of sight 34 from each respective vehicle driver in the vehicles 32 as noted.

The use of the chevron integral block style marking assembly 60 is advisable as provides the line of sight 34 to each of the respective vehicle drivers in the vehicle 32 to warn of approaching or pending traffic turning in front of the respective vehicles 32.

Additionally, as shown in FIG. 1, the intersection from the four-lane highway roadway 20 to a two-lane highway roadway 18 by the two-lane side roadway 16 is shown with one vehicle 32 stopped at the stop sign 38 and the other vehicle 32 traveling on the two-lane highway roadway 18. The line of sight 34 indicates the possibility of an approaching vehicle 32 on the two-lane highway roadway 18 that may be making a dangerous left hand turn therefrom.

Another dangerous intersection from the opposite direction on the two-lane highway roadway 18 is shown in FIG. 1 whereupon the vehicle 32 is stopped at the stop sign 38. The vehicle drivers line of sight 34 sees the chevron block style marking assembly 58 serving as a visual warning of a possible dangerous situation on turning into a vehicle direction of travel 152.

FIG. 2 is a schematic diagram similar to FIG. 1 illustrating a two-lane side roadway 16 intersecting and a two-lane highway roadway 18 and showing the location of various vehicles 32 thereon and utilized with various types of marking means.

For example, in FIG. 2 in the upper left hand portion, a chevron and perpendicular marking means 52 is utilized as to be in the line of sight 34 of the vehicles 32 at stop signs 38. Additionally, a chevron block style marking assembly 58 is utilized by the same stopped vehicles 32 by vehicle drivers to readily observe a dangerous turning situation from an opposite direction.

In the upper right hand portion of FIG. 2, the parked vehicle 32 at the stop sign 38 is operable to readily observe a plurality of spaced single chevron marking assemblies 62 and an inclined block style of the diagonal marking means 48 to provide warnings of the possible approaching traffic that may be turning into the vehicle path of travel 36.

In the lower portion of FIG. 2, an intersection with a two-lane highway roadway 18 with another two-lane highway roadway 18 is illustrated with a parked vehicle 32 at the stop sign 38 and a pair of approaching vehicles 32. The line of sight 34 of a vehicle driver in the vehicle 32 can see a diagonal marking means 48 and a chevron block style marking assembly 58 to provide the various warnings to each vehicle 32 as a warning of a dangerous turning situation.

All of the various marking means 46, 48, 50, 52 are placed in predetermined positions from the various intersections depending on the speed of the through traffic thereon whether 15 to 65 MPH speed limits in 5 MPH increments. The distance of relative speeds passing per second is then utilized to provide for the proper location of the respective marking means to be calculated by a traffic engineer to present the maximum safety features.

The reflector/refractor signal means 54 can be utilized with respect to main striping base members 122 to provide the necessary signaling reflecting structures which is also a monetary decision as to which one would be best suited for a given usage within cost restraints.

In the method of constructing the roadway safety warning system 12 of this invention, the traffic engineer would take the steps of:

1. determining the type of intersection to be involved considering presence of the two-lane side roadway 16 with a two-lane highway roadway 18 or with a four-lane highway roadway 20;

2. determining the relative maximum speed limits and other conditions as far as curves and the like of the intersecting roadways; and 3. determining the type of marking means to be utilized whether 1) a chevron marking means 46; 2) a diagonal marking means 48; 3) a perpendicular marking means 50; or 4) a combination chevron and perpendicular marking means 52.

The traffic engineer would then design a particular roadway safety warning system 12 to be utilized depending on the traffic and road intersecting conditions with the speed limits involved to achieve the utmost warning safety system which basically provides a reflective warning means to a vehicle 32 stopped at a stop sign 38 and approaching vehicles 32 on adjoining roadways to provide a visual warning signal as to a possible dangerous traffic turning intersection area.

A further step is by applying, through paint or plastic strips, the various elements of the respective marking means as by a heat lamination process, adhesive, or a painting method.

The front reflective lead stripes on the various marking means can be painted or a plastic strip of reflected material utilizing the reflector/refractor signal means 54 of this invention. The various embodiments of the reflector/refractor signal means 54 to be utilized may be 1) the intermittent strip assemblies 114; 2) the continuous strip assembly 116; 3) the arcuate raised strip assembly 118; or 4) the inclined raised strip assembly 120.

It is normally a matter of economics as to the amount of money to be utilized whether to provide an illuminated reflector member, either flat on the roadway surface 27 or slightly raised therefrom provided by the reflector strip members 124, the continuous reflector strip members 130, the arcuate reflector members 138, or the inclined reflector members 144.

In all of the marking means 46, 48, 50, and 52, the forward (one, two, or more) stripes 64, 84, 92, 102, or 108 are all constructed of a main body section 70 and a forward or leading reflector section 72. The reflector sections 72 are constructed of a reflective material readily observed from a considerable distance.

In some cases, it may be desirable to place the main body section 70 in a leading position ahead of the reflector section 72 for best visibility from a given observer's position.

While the roadway safety warning system of this invention has been described in conjunction with intersecting two and four lane roadways, the same marking means can be applied to adjacent roadways and access roadways to indicate the presence of a dangerous roadway and railroad track intersection. This is extremely important at the numerous unlighted railroad crossings, especially in rural areas in America.

While the invention has been described in conjunction with preferred specific embodiments thereof, it will be understood that this description is intended to illustrate and not to limit the scope of the invention, which is defined by the following claims:

I claim:

1. A roadway safety warning system adapted to be applied to a roadway surface in a roadway complex, comprising:

a) a chevron marking means secured to the roadway surface at a predetermined distance from a roadway intersection where one or more drivers of vehicles are contemplating turning across at least one lane of traffic;

b) said chevron marking means having a lead stripe with a reflective material of a color other than the color of the roadway surface; and c) said lead stripe is readily observable by a vehicle driver in the vehicles traveling on the roadway surface into the roadway intersection and a vehicle driver stopped at a stop sign adjacent the roadway intersection;

whereby the vehicle drivers are visually alerted to the fact of approaching a potentially dangerous roadway intersection with vehicles possibly turning across one's path of travel.

2. A roadway safety warning system as described in claim 1, wherein:

a) said chevron marking means is a single chevron marking assembly having a lead chevron stripe interconnected on trailing edges by a rear connector stripe; and b) said lead chevron stripe having said reflective material thereon facing the roadway intersection.

3. A roadway safety warning system as described in claim 2, including:

a) a plurality of said single chevron marking assemblies are secured to said roadway surface in a spaced series relationship at engineered spacing depending on a speed limit on subject roadway to present multiple visual warning signals at one second speed limit intervals.

4. A roadway safety warning system as described in claim 1, wherein:

a) said chevron marking means includes a chevron marking assembly having said lead stripe, intermediate chevron stripes, and a rear chevron stripe, all of a chevron V-shape and nestled within adjacent ones of each other.

5. A roadway safety warning system as described in claim 1, wherein:

a) said chevron marking means includes a chevron block style marking assembly having a generally rectangular shape peripheral outline;

b) said chevron block style marking assembly includes partial lead chevron stripes, said lead stripe, intermediate chevron stripes, and trailing chevron stripes, all nestled within adjacent ones of each other; and c) said partial lead chevron stripes and said lead stripe having said reflective material thereon to provide a visual warning to the vehicle drivers having a line of sight to said marking means.

6. A roadway safety warning system as described in claim 1, wherein:

a) said chevron marking means includes a chevron integral block style marking assembly of a generally rectangular shape peripheral outline;

b) said chevron integral block style marking assembly includes partial lead chevron stripes, said lead stripe, intermediate chevron stripes, and trailing chevron stripes;

c) said partial lead chevron stripes and said lead stripe having said reflective material thereon to present a visual signal to the vehicle drivers having a line of sight to said marking means; and d) said lead stripe, said intermediate chevron stripe, and said trailing chevron stripe, all interconnected at respective mid-points to a central anchor section which simplifies application to the roadway surface.

7. A roadway safety warning system as described in claim 1, wherein:

a) said lead stripe includes a stripe assembly having a striping base member connected to a reflector stripe member; and b) said reflector stripe member having intermittent stripe members along said striping base member and constructed of a reflector/refractor material to present a visual warning signal to a line of sight to a vehicle driver in a moving or parked vehicle.

8. A roadway safety warning system as described in claim 1, wherein:

a) said lead stripe includes a stripe assembly having a striping base member connected to a reflector stripe member; and b) said reflector stripe member having a continuous reflector stripe member along said striping base member and constructed of a reflector/refractor material to present a visual warning signal to a line of sight to a vehicle driver in a moving or parked vehicle.

9. A roadway safety warning system as described in claim 1, wherein:

a) said lead stripe includes a striping base member connected to an arcuate reflector member constructed of a reflector/refractor material; and b) said arcuate reflector member extended above said striping base member to elevate a stripe reflector member to assist in observance of a visual warning signal to a line of sight to a vehicle driver in a moving or parked vehicle.

10. A roadway safety warning system as described in claim 1, wherein:

a) said lead stripe includes a striping base member connected to an inclined raised stripe assembly constructed of a reflector/refractor material;

b) said inclined raised stripe assembly having an inclined reflector member extended above said striping base member to assist in observance of a visual warning signal to a line of sight to a vehicle driver in a moving or parked vehicle.

11. A roadway safety warning system adapted to be applied to a roadway surface in a roadway complex, comprising:

a) a marking means secured to the roadway surface at a predetermined distance from a roadway intersection where one or more drivers of vehicles are contemplating turning across at least one lane of traffic;

b) said marking means includes a diagonal marking means having a plurality of spaced, adjacent, parallel diagonal stripes extended at an angle relative to a direction of travel of the vehicle on the roadway so as to be readily observable by a vehicle driver stopped at a stop sign adjacent an outer edge of the roadway intersection.

12. A roadway safety warning system as described in claim 11, wherein:

a) said diagonal stripes inclined at another angle relative to the direction of travel so as to be readily observed by a driver of a vehicle traveling or stopped at a stop sign on an opposite side of the roadway intersection.

13. A roadway safety warning system as described in claim 11, wherein:

a) said marking means includes a perpendicular marking means having a plurality of spaced, adjacent, parallel perpendicular stripes extended perpendicular to a direction of travel of a vehicle on the roadway surface so as to be readily observable by a vehicle driver in an approaching vehicle or a vehicle stopped at a stop sign.

14. A roadway safety warning system as described in claim 11, wherein:

a) said marking means includes a chevron and perpendicular marking means having a perpendicular marking section integral with respective adjacent portions of a chevron marking section;

b) said perpendicular marking section includes a plurality of adjacent, parallel stripe members;

c) said chevron marking section includes a plurality of adjacent, parallel chevron members; and d) respective ones of said stripe members integral with adjacent ones of said chevron members to provide respective visual warning signals to vehicle drivers in vehicles parked at stop signs in close proximity.

15. A roadway safety warning system as described in claim 14, wherein:

a) lead ones of said stripe members and said chevron members having said reflective material thereon to provide a visual warning signal to a vehicle driver on approaching a potentially dangerous intersection.

16. A method of constructing a roadway safety warning system on a roadway complex having two-lane side and highway roadways intersecting each other and intersecting a four-lane highway roadway without the use of electrical signal light means, comprising the following steps:

a) placing stop signs at intersections of two-lane side and highway roadways with each other;

b) applying marking means having reflective material thereon to roadway surfaces at engineered spaced locations from respective ones of the stop signs;

c) observing said reflective material by a line of sight by a vehicle driver in vehicles stopped at respective stop signs, thereby providing a visual warning of a potentially dangerous intersection with possible turning vehicles to be encountered; and d) selecting one of said marking means from chevron, diagonal, perpendicular, and chevron/perpendicular marking means depending on speed limit of subject two-lane side and highway roadways and line of sight by the vehicle drivers in the vehicles stopped at respective stop signs.

17. A method of constructing a roadway safety warning system as described in claim 16, including:

a) placing stop signs at intersections of two-lane side and highway roadways with said four-lane highway roadway; and b) placing marking means of a sufficient width to cover adjacent lanes of traffic flowing in the same direction on the four-lane highway roadway to provide visual signals to vehicle drivers approaching an intersection on said four-lane highway roadway to visually signal a potentially dangerous vehicle turning area.

18. A method of constructing a roadway safety warning system as described in claim 16, including:

a) selecting said marking means from 1) a chevron marking means; and 2) a chevron and perpendicular marking means operable to present dual visual warning to different lines of sight from vehicle drivers in respective ones of the vehicles.

19. A method of constructing a roadway safety warning system as described in claim 16, including:

a) selecting said marking means from 1) a diagonal making means and 2) a perpendicular marking means to present a visual warning to a line of sight from vehicle drivers in respective ones of the vehicles.

20. A roadway safety warning system adapted to be applied to a roadway surface in a roadway complex having a four-lane highway roadway intersected by two-lane side roadways and a two-lane highway roadway intersected by two-lane side roadways, comprising:

a) stop signs on the two-lane side roadway at points of intersection with the two-lane highway roadway and the four-lane highway roadway;

b) marking means secured to the roadway surface on the two-lane highway roadway at a predetermined distance from the stop signs on the two-lane side roadway intersecting the four-lane highway roadway;

c) said marking means having a lead stripe with a reflective material inclined relative to a direction of travel on the four-lane highway roadway; and d) said lead stripe is readily observable by a vehicle driver stopped at the stop sign on the two-lane side roadway to warn of a dangerous intersection.

21. A roadway safety warning system as described in claim 20, wherein:

a) said marking means is a single chevron marking assembly having a lead chevron stripe interconnected on trailing edges by a rear connector stripe; and b) said lead chevron stripe having said reflective material thereon facing the roadway intersection;

c) a plurality of said single chevron marking assemblies are secured to said roadway surface in a spaced series relationship at engineered spacing depending on a speed limit on subject roadway to present multiple visual warning signals at one second speed limit intervals.

22. A roadway safety warning system as described in claim 20, wherein:

a) said marking means includes a chevron block style marking assembly having a generally rectangular shape peripheral outline;

b) said chevron block style marking assembly includes partial lead chevron stripes, said lead stripe, intermediate chevron stripes, and trailing chevron stripes, all nestled within adjacent ones of each other; and c) said partial lead chevron stripes and said lead stripes having said reflective material thereon to provide a visual warning to the vehicle drivers having a line of sight to said marking means.

23. A roadway safety warning system as described in claim 20, wherein:

a) a second marking means includes a chevron integral block style marking assembly of a generally rectangular shape peripheral outline secured to the roadway surface on the four-lane highway roadway;

b) said chevron integral block style marking assembly includes partial lead chevron stripes, said lead stripe, intermediate chevron stripes, and trailing chevron stripes;

c) said partial lead chevron stripes and said lead stripe having said reflective material thereon to present a visual signal to the vehicle drivers having a line of sight to said second marking means; and d) said lead stripe, said intermediate chevron stripe, and said trailing chevron stripe, all interconnected at respective mid-points to a central anchor section which simplifies application to the roadway surface.

24. A roadway safety warning system as described in claim 20, wherein:

a) said marking means includes a chevron and perpendicular marking means having a perpendicular marking section integral with respective adjacent portions of a chevron marking section;

b) said perpendicular marking section includes a plurality of adjacent, parallel stripe members;

c) said chevron marking section includes a plurality of adjacent, parallel chevron members; and d) respective ones of said stripe members integral with adjacent ones of said chevron members to provide respective visual warning signals to vehicle drivers in vehicles parked at stop signs in close proximity.

* * * * *